US007667679B2

(12) United States Patent
Park et al.

(10) Patent No.: US 7,667,679 B2
(45) Date of Patent: Feb. 23, 2010

(54) LIQUID CRYSTAL DISPLAY, METHOD FOR DETERMINING GRAY LEVEL IN DYNAMIC CAPACITANCE COMPENSATION ON LCD, AND METHOD FOR CORRECTING GAMMA OF LCD

(75) Inventors: Bong-im Park, Asan (KR); Woo-chul Kim, Asan (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 737 days.

(21) Appl. No.: 11/213,914

(22) Filed: Aug. 30, 2005

(65) Prior Publication Data

US 2006/0044242 A1 Mar. 2, 2006

(30) Foreign Application Priority Data

Aug. 30, 2004 (KR) ..... 10-2004-0068607

(51) Int. Cl.
*G09G 3/36* (2006.01)

(52) U.S. Cl. ..... 345/89

(58) Field of Classification Search ..... None
See application file for complete search history.

(56) References Cited

U.S. PATENT DOCUMENTS 7,034,793 B2 * 4/2006 Sekiya et al. ..... 345/98
7,142,183 B2 * 11/2006 Lee ..... 345/87
2003/0214473 A1 * 11/2003 Lee ..... 345/87

* cited by examiner

*Primary Examiner*—Sumati Lefkowitz
*Assistant Examiner*—Tammy Pham
(74) *Attorney, Agent, or Firm*—Innovation Counsel LLP

(57) ABSTRACT

A liquid crystal display, a method for determining a dynamic capacitance compensation (DCC) gray level, and a method for correcting a gamma value of the liquid crystal display are provided. The liquid crystal display includes a liquid crystal panel, a gate driver, a data driver, a gray scale voltage provider, and a DCC gray level provider consisting of a DCC gray scale voltage generator and a DCC processor.

9 Claims, 14 Drawing Sheets

LIQUID CRYSTAL DISPLAY, METHOD FOR DETERMINING GRAY LEVEL IN DYNAMIC CAPACITANCE COMPENSATION ON LCD, AND METHOD FOR CORRECTING GAMMA OF LCD

This application claims priority from Korean Patent Application No. 10-2004-0068607 filed on Aug. 30, 2004 in the Korean Intellectual Property Office, which is hereby incorporated by reference for all purposes as if fully set forth herein.

BACKGROUND OF THE INVENTION

1. Field of the Invention

The present invention relates to a liquid crystal display (LCD), a method for determining a gray level in dynamic capacitance compensation (DCC) on the LCD, and a method for correcting a gamma of the LCD, and more particularly, to an LCD to improve the quality of moving and still images, a method for determining a gray level in DCC for the LCD to improve moving picture quality, and a method for correcting a gamma of the LCD to improve still picture quality.

2. Description of the Related Art

Cathode ray tubes (CRTs) are being gradually replaced by flat panel displays such as LCDs, plasma display panels (PDPs), and organic electroluminescent displays (OELDs). LCDs are popular because they are lightweight and thin.

LCDs include an upper glass substrate on which a common electrode and a color filter are formed, a lower glass substrate on which a thin film transistor (TFT) and a pixel electrode are formed, and an anisotropic dielectric constant liquid crystal filled between the upper and lower glass substrates. An electric field intensity in the liquid crystal is controlled by a potential that is independently applied to the pixel electrode and the common electrode. The electric field alters the molecular configuration of the liquid crystal and thus controls the amount of light transmitted through the substrates to display a desired image. For example, LCDs using a TFT as a switching device are most commonly used, which are referred to as TFT-LCDs.

In a typical LCD, a gray scale voltage to be applied to a pixel electrode is determined according to a gamma value. FIG. 1 is a circuit diagram illustrating a method for adjusting a gamma value on a conventional LCD. Referring to FIG. 1, once the gamma value is determined, each voltage VO<0> through VO<255> that is applied to a corresponding node between a row of serially connected resistors R0 through R255 is used as a gray scale voltage corresponding to the gamma value by adjusting the ratio of resistances of resistors in the row. Correcting the gamma according to the type of liquid crystal in an LCD or environmental illumination makes it possible to control the brightness across the entire screen, which improves still picture quality. However, in conventional LCDs, a resistance value must be adjusted by replacing resistors in each row or using a variable resistor in order to correct a gamma value. Thus, it is difficult to improve the quality of still images.

When a gray scale voltage is applied to a pixel electrode in an LCD, a liquid crystal material takes time to respond to the gray scale voltage. Thus, due to the time delay required to display the desired image, it is difficult to display a moving image.

Dynamic capacitance compensation (DCC) is a technique that has been developed to improve the response speed of the LCD. The DCC technique minimizes the time delay by applying a gray scale voltage that is greater than the original gray scale voltage to a pixel electrode.

FIG. 2 is a graph of an optimal liquid crystal response curve applicable for applying a DCC technique on a conventional LCD. Referring to FIG. 2, in the conventional DCC technique, after comparing a gray scale voltage Gk- 1 for a previous frame with a gray scale voltage Gk for a current frame, each of gray scale voltages Gbst1, Gbst2, and Gbst3 that is greater than the difference between the gray scale voltages Gk- 1 and Gk, plus the gray scale voltage Gk- 1 for the previous frame, is applied during a single frame period (e.g., 1/60 sec in the case of a 60 Hz frame rate), shown as 1 frame in FIG. 2, and the original gray scale voltage Gk is applied after the frame period.

An optimal liquid crystal response curve Res2 is then determined from among the measured liquid crystal response curves Res1, Res2, and Res3. The gray scale voltage corresponding to the optimal response curve Res2 and the gray scale voltages for the previous and current frames are mapped to gray scale levels that are stored in a look-up table (LUT). Since the optimal liquid crystal response curve Res2 is determined by observer's judgment and not a calculation, the optimal liquid crystal response curve Res2 suffers from an inter-observer error or a discrepancy in each measurement, making it difficult to objectively apply a DCC technique. Further, since a separate DCC LUT is required for each corrected gamma value, it is difficult to improve both moving and still picture quality.

SUMMARY OF THE INVENTION

The present invention provides a liquid crystal display (LCD) designed to effectively improve the quality of moving and still images.

The present invention also provides a method for determining a gray level in dynamic capacitance compensation (DCC) for the LCD to effectively improve moving picture quality.

The invention also provides a method for correcting a gamma value of the LCD to effectively improve still picture quality.

The present invention also provides a method for determining a gray level in DCC for the LCD and correcting a gamma value of the LCD to effectively improve the quality of moving and still pictures.

Additional features of the invention will be set forth in the description which follows, and in part will be apparent from the description, or may be learned by practice of the invention.

The invention discloses a liquid crystal display including a liquid crystal panel including a plurality of gate lines, a plurality of data lines, and a plurality of pixels formed in an area defined by the gate lines and the data lines, each pixel including a switching element connected with a corresponding gate line and a corresponding data line, and a capacitor provided between the switching element and a common electrode, a gate driver applying gate signals to the gate lines, a data driver providing gray scale voltages corresponding to data signals for gray levels having a predetermined gamma value to the data lines, a gray scale voltage generator generating gray scale voltages for gray levels having the predetermined gamma value and transmitting the generated gray scale voltages to the data driver, and a dynamic capacitance compensation processor, including a dynamic capacitance compensation gray scale voltage generator, and a dynamic capacitance compensation gray level generator, wherein the dynamic capacitance compensation gray scale voltage generator applies a first gray scale voltage having the predetermined gamma value to a pixel electrode during a plurality of frame periods, a second gray scale voltage having a predetermined difference from the first gray scale voltage to the pixel electrode during a single frame period, and a third gray scale voltage relating to a peak gray scale voltage in the pixel electrode during the single frame when the second gray scale voltage is applied, stores the first gray scale voltage, the second gray scale voltage, and the third gray scale voltage in a look-up table, and stores the second gray scale voltage and the third gray scale voltage for each of a plurality of first gray scale voltages in the look-up table, and wherein the dynamic capacitance compensation gray level generator receives the first gray scale voltage, the second gray scale voltage, and the third gray scale voltage stored in the look-up table from the dynamic capacitance compensation gray scale voltage generator, converts the first gray scale voltage, the second gray scale voltage, and the third gray scale voltage into a first gray level, a second gray level, and a third gray level, respectively, using the predetermined gamma value, stores the first gray level, the second gray level, and the third gray levels as a gray level for a previous frame period, a dynamic capacitance compensation gray level, and a gray level for a current frame period, respectively, compares the gray level for the current frame data with the gray level for the previous frame data, generates a dynamic capacitance compensation gray level according to the comparison result, and provides the dynamic capacitance compensation gray level to the data driver.

The invention further discloses a liquid crystal display including a liquid crystal panel including a plurality of gate lines and data lines, and a plurality of pixels provided in an area defined by the gate lines and the data lines, wherein each pixel including a switch connected with one of the gate lines and one of the data lines, and a capacitor provided between the switch and a common electrode, a gate driver providing signals to the gate lines, a data driver providing gray scale voltages to the data lines, and a gray scale voltage provider including a first look-up table storing a set of quadratic equation coefficients calculated for every three measured data from among a plurality of data representing transmittance of the liquid crystal display that are a function of gray scale voltages, a second look-up table for calculating a gray level and a transmittance value such that the relationship between the gray level (GrayLevel) and the transmittance (T) for a specified gamma value γ satisfies: $T=T_{max}*(\text{GrayLevel}/\text{Maximum GrayLevel})^{\gamma}$, and a gray scale voltage generator generating gray scale voltages for gray levels by a piecewise quadratic interpolation using the stored set of quadratic equation coefficients and the stored gray level and transmittance value and transmitting the gray scale voltages to the data driver.

The invention further discloses a liquid crystal display including a liquid crystal panel including a plurality of gate lines and data lines, and a plurality of pixels provided in an area defined by the gate lines and data lines, wherein each pixel includes a switching element connected with one of the gate lines and one of the data lines, a capacitor provided between the switching element and a common electrode, a gate driver providing signals to the gate lines, a data driver providing gray scale voltages to the data lines, a gray scale voltage provider including a first look-up table storing a set of quadratic equation coefficients for every three measured data from among a plurality of data representing transmittance values of the liquid crystal display as a function of gray scale voltages, a second look-up table for storing gray levels and transmittance values and calculating the gray levels and the transmittance values so that the relationship between the gray level (GrayLevel) and the transmittance value (T) for a specified gamma value γ satisfies $T=T_{max}*(\text{GrayLevel}/\text{Maximum GrayLevel})^{\gamma}$, and a gray scale voltage generator generating gray scale voltages for gray levels by piecewise quadratic interpolation using the stored set of quadratic equation coefficients stored and the stored gray levels and transmittance values and transmitting the gray scale voltages to the data driver, and a dynamic capacitance compensation processor including a dynamic capacitance compensation gray scale voltage generator applying a first gray scale voltage corresponding to a first one of gray levels having the predetermined gamma value γ to a pixel electrode during a plurality of frame periods, a second gray scale voltage corresponding to a second gray level having a predetermined difference from the first gray level to the pixel electrode during a one frame period and the first gray scale voltage to the pixel electrode during a plurality of frame periods, stores the first gray scale voltage, the second gray scale voltage, and a third gray scale voltage in a dynamic capacitance compensation gray scale voltage look-up table, wherein the third gray scale voltage is a peak gray scale voltage measured in the pixel electrode during the one frame period when the second gray scale voltage is applied, and stores the second gray scale voltage and the third gray scale voltage for each of a plurality of first gray scale voltages in the dynamic capacitance compensation gray scale voltage look-up table, and a dynamic capacitance compensation gray level generator receiving and converting the first gray scale voltage, the second gray scale voltage, and the third gray scale voltage the first gray level, the second gray level, and the third gray level, respectively, using the predetermined gamma value γ, storing the first gray level, the second gray level, and the third gray level as a gray level for a previous frame period, a dynamic capacitance compensation gray level, and a gray level for a current frame period, respectively, comparing the gray level for the current frame data with the gray level for the previous frame data, generating a dynamic capacitance compensation gray level according to the comparison result, and providing the dynamic capacitance compensation gray level to the data driver.

The invention further discloses a method of determining a dynamic capacitance compensation gray level on a liquid crystal display, the method including storing a dynamic capacitance compensation gray level by applying a first gray scale voltage corresponding to a first gray level having a predetermined gamma value to a pixel electrode during a plurality of frame periods, applying a second gray scale voltage corresponding to a second gray level having a predetermined difference from the first gray level to the pixel electrode during a one frame period, applying the first gray scale voltage to the pixel electrode during a plurality of frame periods, and storing the first gray scale voltage, the second gray scale voltage, and a third gray scale voltage in a dynamic capacitance compensation gray scale voltage look-up table, the third gray scale voltage is a peak gray scale voltage measured in the pixel electrode during the one frame period when the second gray scale voltage is applied and corresponds to a third gray level, and converting a gray scale voltage into a dynamic capacitance compensation gray scale level by converting the first gray scale voltage, the second gray scale voltage, and the third gray scale voltage into the first gray level, the second gray level, and the third gray level using the predetermined gamma value, and storing the first gray level, the second gray level, and the third gray level as a gray level for a previous frame period, a dynamic capacitance compensation gray level, and a gray level for a current frame period, respectively.

The invention further discloses a method for a gamma value of a liquid crystal display, the method including calculating a set of quadratic equation coefficients for every three measured data from a plurality of data representing transmittance values of the liquid crystal display that are a function of gray scale voltages, to satisfy the three adjacent measured data, and storing the set of quadratic equation coefficients in a first look-up table, calculating gray levels and transmittance values so the relationship between a gray level (GrayLevel) and a transmittance (T) for a specified gamma value $\gamma$ satisfies $T=T_{max}*(\text{GrayLevel}/\text{Maximum GrayLevel})^{\gamma}$ and storing the gray levels and transmittance values in a second look-up table, and generating gray scale voltages for gray levels by piecewise quadratic interpolation using the set of quadratic equation coefficients stored in the first look-up table and the gray levels and transmittance values stored in the second look-up table.

The invention further discloses a method of determining a dynamic capacitance compensation gray level and correcting a gamma value on a liquid crystal display, the method including storing a dynamic capacitance compensation gray level by applying a first gray scale voltage corresponding to a first gray level having a predetermined gamma value to a pixel electrode during a plurality of frame periods, applying a second gray scale voltage corresponding to a second gray level having a predetermined difference from the first gray level to the pixel electrode during a one frame period, applying the first gray scale voltage to the pixel electrode during a plurality of frame periods, and storing the first gray scale voltage, the second gray scale voltage, and a third gray scale voltage in a dynamic capacitance compensation gray scale voltage look-up table, the third gray scale voltage is a peak gray scale voltage measured in the pixel electrode during the one frame period when the second gray scale voltage is applied and corresponds to a third gray level, repeating the applying of the first gray scale voltage, the second gray scale voltage, and the first gray scale voltage, and the storing of the first gray scale voltage, the second gray scale voltage, and the third gray scale voltage for each of a plurality of first gray scale voltages, calculating a set of quadratic equation coefficients for every three measured data from among a plurality of data representing transmittance of the liquid crystal display that are a function of gray scale voltages to satisfy the three adjacent measured data, and storing the set of quadratic equation coefficients in a first look-up table, calculating gray levels and transmittance so the relationship between a gray level (GrayLevel) and a transmittance (T) for the predetermined gamma value $\gamma$ satisfies $T=T_{max}*(\text{GrayLevel}/\text{Maximum GrayLevel})^{\gamma}$ and storing the gray levels and transmittance in a second look-up table, generating gray scale voltages for gray levels by piecewise quadratic interpolation using the set of quadratic equation coefficients stored in the first look-up table and the gray levels and transmittance stored in the second look-up table, and converting a gray scale voltage into a dynamic capacitance compensation gray scale level by converting the first gray scale voltage, the second gray scale voltage, and the third gray scale voltages stored in the dynamic capacitance compensation gray scale voltage look-up table into the first gray level, the second gray level, and the third gray level using the predetermined gamma value, and storing the first gray level, the second gray level, and the third gray level as a previous frame period gray level, a dynamic capacitance compensation gray level, and a current frame period gray level, respectively.

The invention further discloses a liquid crystal display having a liquid crystal panel, including a data driver providing gray scale voltages to the liquid crystal panel, and a gray scale voltage provider including a first look-up table storing a set of quadratic equation coefficients calculated for every three measured data from among a plurality of data representing transmittance of the liquid crystal display that are a function of gray scale voltages, a second look-up table storing gray levels and transmittance values corresponding to specific gamma values of the liquid crystal display, and a gray scale voltage generator generating gray scale voltages for gray levels by a piecewise quadratic interpolation using the set of quadratic equation coefficients stored in the first look-up table and the gray levels and transmittance stored in the second look-up table and transmitting the gray scale voltages to the data driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DESCRIPTION OF THE ILLUSTRATED EMBODIMENTS

Figure 1:
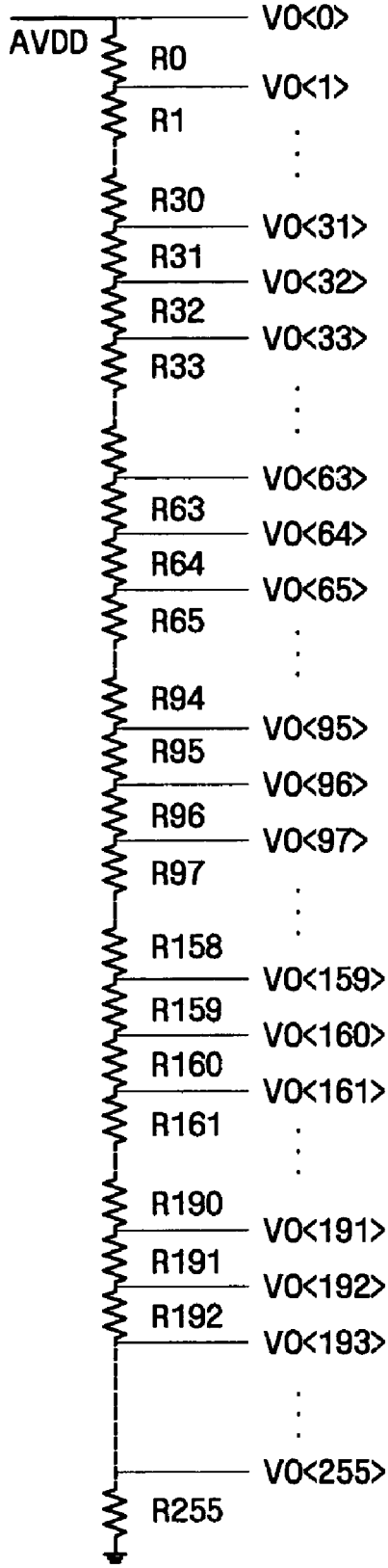
FIG. 1 is a circuit diagram showing a method for adjusting a gamma value on a conventional liquid crystal display.
Figure 2:
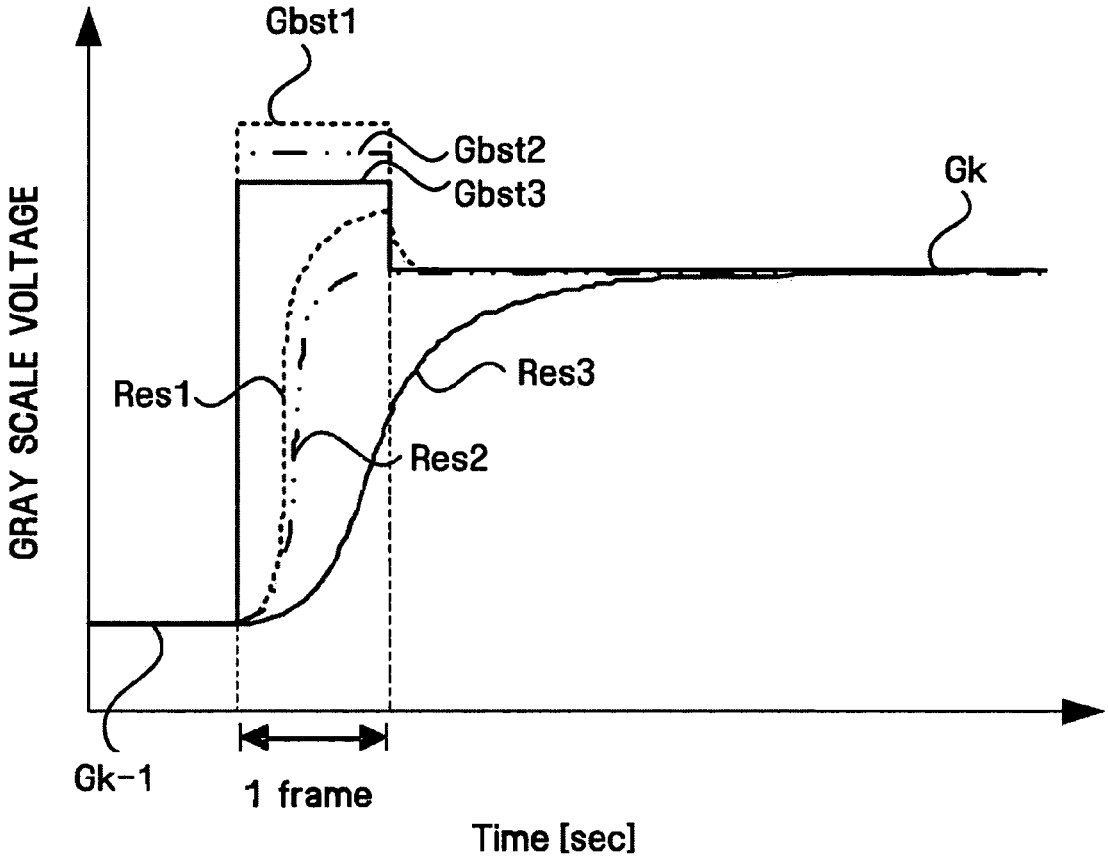
FIG. 2 is a graph showing an optimal response curve for applying a dynamic capacitance compensation technique on a conventional liquid crystal display.

Advantages and/or features of the present invention and methods of accomplishing the same may be understood more readily by reference to the following detailed description of embodiments and the accompanying drawings. The present invention may, however, be embodied in many different forms and should not be construed as being limited to the embodiments set forth herein. Like reference numerals refer to like elements throughout the specification.

A liquid crystal display (LCD) according to an embodiment of the invention is described below with reference to FIGS. 3, 4, 5, and 6.

Figure 3:
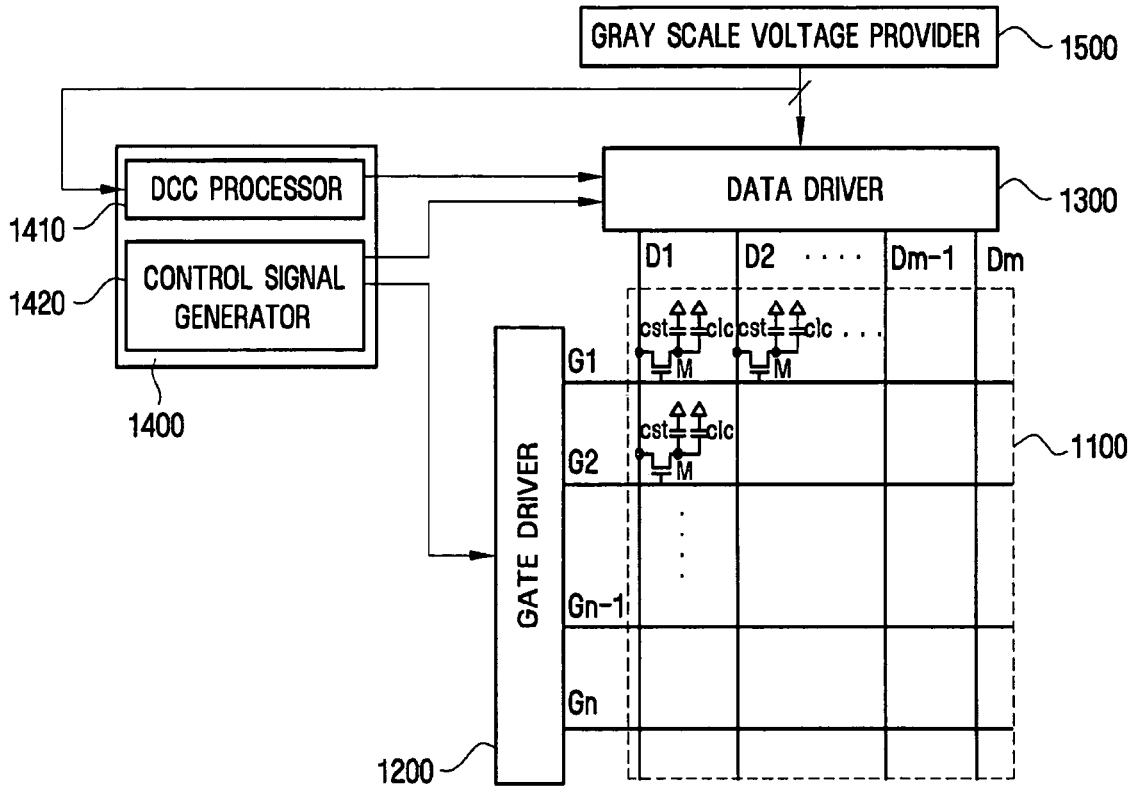
FIG. 3 shows the structure of an LCD according to an embodiment of the invention.
Figure 4:
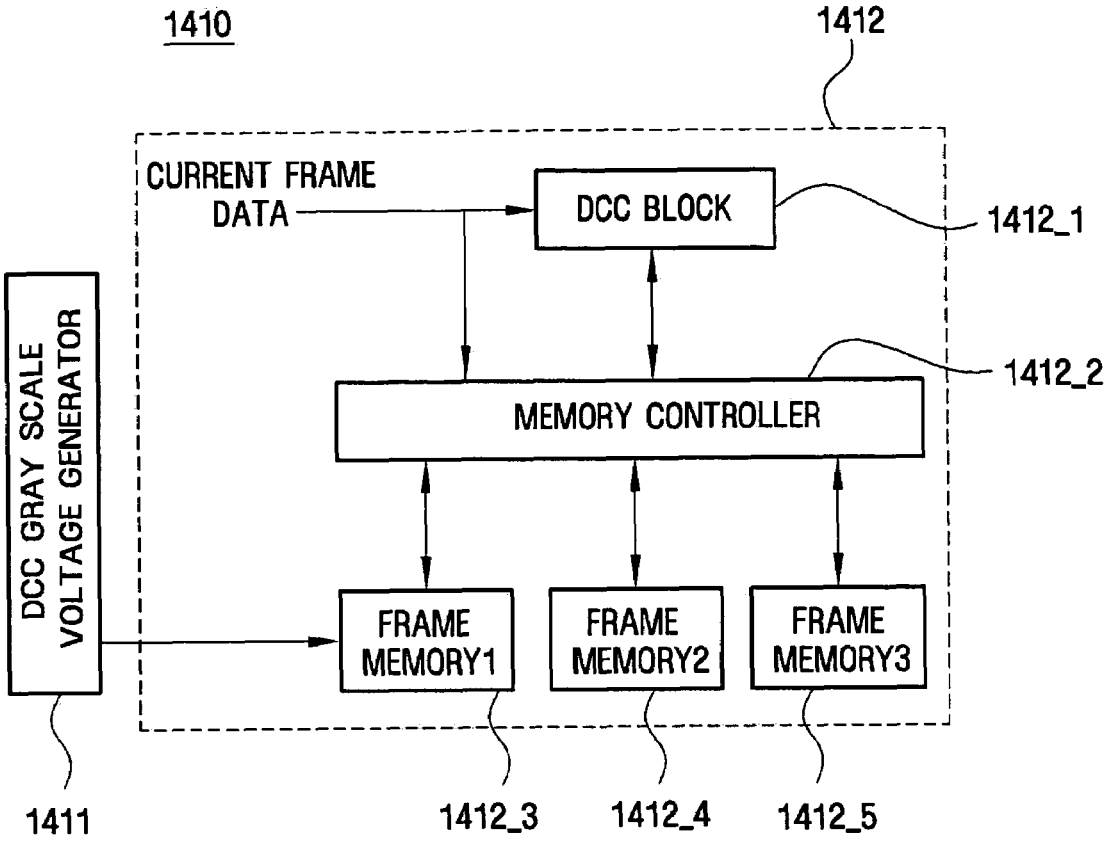
FIG. 4 shows the configuration of the DCC processor in the LCD, shown in FIG. 3.
Figure 5:
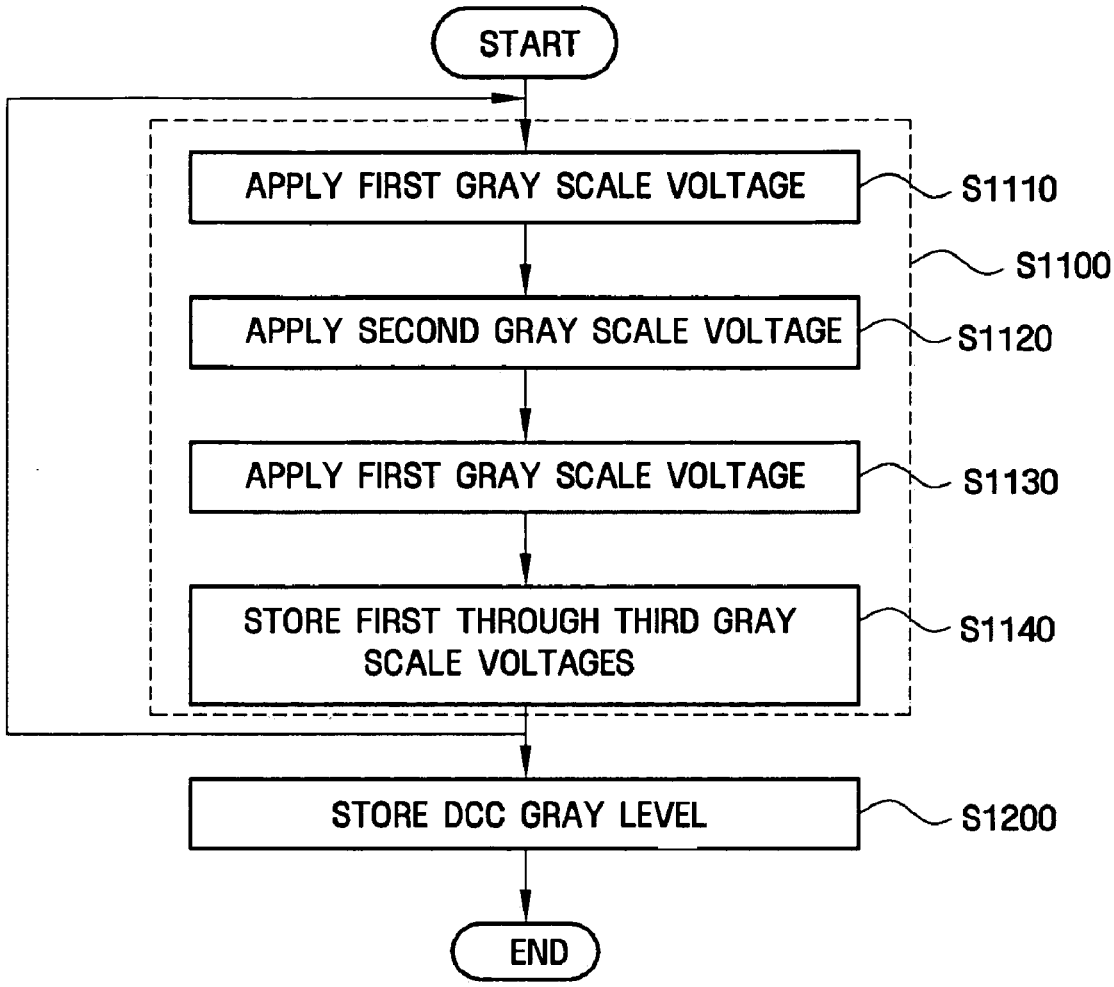
FIG. 5 is a flowchart showing a method of determining a gray level in DCC on the LCD of FIG. 3 according to an embodiment of the invention.
Figure 6:
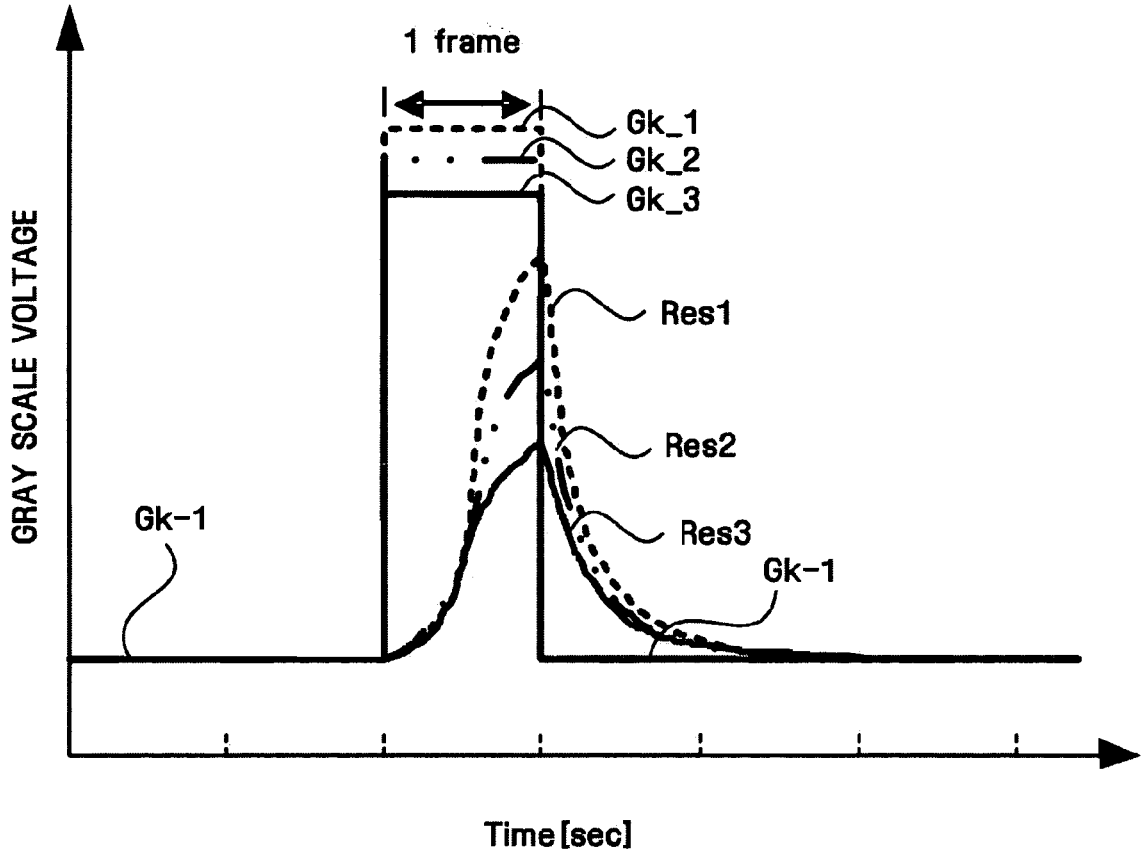
FIG. 6 is a graph illustrating first through third gray scale voltages stored when storing gray scale voltages in a DCC for the LCD shown in FIG. 3.

FIG. 3 shows the structure of an LCD according to an embodiment of the invention, FIG. 4 shows the configuration of the DCC processor in the LCD shown in FIG. 3, FIG. 5 is a flowchart showing a method of determining a gray level in DCC for the LCD shown in FIG. 3 according to an embodiment of the invention, and FIG. 6 is a graph illustrating first through third gray scale voltages stored when storing gray scale voltages in a DCC for the LCD shown in FIG. 3.

Referring to FIG. 3, the LCD includes a liquid crystal panel 1100, a gate driver 1200, a data driver 1300, a timing controller 1400, and a gray scale voltage provider 1500.

The liquid crystal panel 1100 includes a plurality of pixels connected to a plurality of gate lines G1 through Gn and a plurality of data lines D1 through Dm. Each of the plurality of pixels include a switching element M connected with a corresponding one of the plurality of gate lines G1 through Gn and a corresponding one of the plurality of data lines D1 through Dm, and a liquid crystal capacitor Clc and a storage capacitor Cst connected with the switching element M.

Each of the plurality of gate lines G1 through Gn extending in a same row direction transmits a gate signal to the corresponding switching element M, and each of the plurality of data lines D1 through Dm extending in an opposite row direction to the plurality of gate lines G1 through Gn, e.g., a column direction, applies a gray scale voltage corresponding with a data signal to the switching element M. The switching element M may be a three-terminal device that includes a control terminal connected with the corresponding gate line, an input terminal connected with the corresponding data line, and an output terminal connected with a terminal of the liquid crystal capacitor Clc and the storage capacitor Cst.

A metal-oxide-semiconductor (MOS) transistor may be used as the switching element M. The MOS transistor may be a thin film transistor (TFT) having amorphous silicon or polycrystalline silicon as a channel layer. The liquid crystal capacitor Clc is connected between the output terminal of the switching element M and a common electrode (not shown). The storage capacitor Cst may be connected between the output terminal of the switching element M and the common electrode (a separate wire method) or may be connected between the output terminal of the switching element M and a previous gate line (a previous gate method).

The gate driver 1200 is connected with the plurality of gate lines G1 through Gn and applies a gate signal to activate the switching element M of the plurality of gate lines G1 through Gn. The data driver 1300 coupled with the plurality of data lines D1 through Dm receives gray scale voltages, i.e., data signals, for gray levels corresponding with a predetermined gamma value (e.g., $\gamma$=2.2) from the gray scale voltage provider 1500 and provides the gray scale voltages to the plurality of data lines D1 through Dm. The gray scale voltage provider 1500 generates gray scale voltages for gray levels with a predetermined gamma value and transmits the generated gray scale voltages to the data driver 1300.

The timing controller 1400 includes a DCC processor 1410 and a control signal generator 1420. FIG. 4 shows the configuration of the DCC processor 1410 according to an embodiment of the invention. Referring to FIG. 4, the DCC processor 1410 includes a DCC gray scale voltage generator 1411 and a DCC gray level generator 1412. The control signal generator 1420 produces a horizontal synchronization start signal for transmission to the data driver 1300 or a gate clock signal for transmission to the gate driver 1200. The detailed operation of the DCC processor 1410 is described below with reference to FIGS. 4, 5, and 6.

FIG. 5 is a flowchart showing a method of determining a gray level in DCC according to an embodiment of the invention.

Referring to FIG. 5, the method of determining a gray level in DCC includes storing a DCC gray scale voltage (operation S1100) and storing a DCC gray level (operation S1200).

The operation S1100 is divided into operations S1110, S1120, S1130, and S1140.

In operation S1110, a first gray scale voltage Gk- 1 corresponding with a first one of gray levels having a predetermined gamma value is applied to a pixel electrode during a plurality of frame periods.

In operation S1120, a second gray scale voltage Gk corresponding with a second gray level having a predetermined difference from the first gray level is applied to the pixel electrode during one frame period.

In operation S1130, the first gray scale voltage Gk- 1 is applied to the pixel electrode during a plurality of frame periods.

In operation S1140, a peak gray scale voltage measured in the pixel electrode during the one frame period when the second gray scale voltage Gk is applied is defined as a third gray scale voltage Res1. The first gray scale voltage Gk- 1, the second gray scale voltage Gk, and the third gray scale voltage Res1 are stored in a DCC gray scale voltage look-up table (LUT) located within the DCC gray scale voltage generator 1411.

FIG. 6 is a graph showing the first, second, and third gray scale voltages Gk- 1, is Gk, and Res1, stored during the operation S1140.

Referring to FIG. 6, when the second gray scale voltage Gk is applied, a response curve having a peak value during the one frame period when the second gray scale voltage Gk is applied may be obtained, thereby effectively preventing or reducing an inter-observer error and an error occurring in each measurement.

The first gray scale voltage Gk- 1 may be applied to the pixel electrode during more than three time periods before and after the second gray scale voltage Gk is applied. By applying the first gray scale voltage Gk- 1 to the pixel electrode over the same frame periods before and after the second gray scale voltage Gk is applied, the third gray scale voltage Res1 may be more effectively measured when a response time of liquid crystal is slow.

In operation S1100, the operations S1110, S1120, S1130, and S1140 are performed once each on a plurality of first gray scale voltages Gk- 1. The number of the first and second gray scale voltages Gk- 1 and Gk may be determined considering both memory constraint and accuracy of DCC gray scale voltages.

In operation S1200 of converting the gray scale voltage into the DCC gray level, a memory controller 1412_2 of the DCC gray level generator 1412 receives the first, second, and third gray scale voltages Gk- 1, Gk, and Res1, which are stored in the DCC gray scale voltage LUT, from the gray scale voltage provider 1500 and respectively converts the first, second, and third gray scale voltages Gk- 1, Gk, and Res1 into first, second, and third gray levels using the predetermined gamma value. The first, second, and third gray levels are stored in a frame memory 1 1412_3 as a gray level for the previous frame period, a DCC gray level, and a gray level for the current frame period, respectively.

When the current frame data is transmitted from an external graphic source to a DCC block 1412_1 and the memory controller 1412_2, the previous frame data stored in a frame memory 2 1412_4 is subsequently transmitted to the DCC block 1412_1 through the memory controller 1412_2. The DCC block 1412_1 compares a gray level for the current frame data with a gray level for the previous frame data, generates a DCC gray level according to the comparison result, and provides the DCC gray level to the data driver 1300. The current frame data is stored in the frame memory 3 1412_5 via the memory controller 1412_2.

Since DCC gray scale voltages are stored in the DCC gray scale voltage LUT, the DCC gray level generator 1412 may easily provide DCC gray levels using gray levels corresponding with gray scale voltages received from the gray scale voltage provider 1500 when a gamma value is corrected.

An LCD according to another embodiment of the invention and a method for correcting a gamma value of the LCD according to an embodiment of the present invention are described below with reference to FIGS. 7, 8, 9, and 10.

Figure 7:
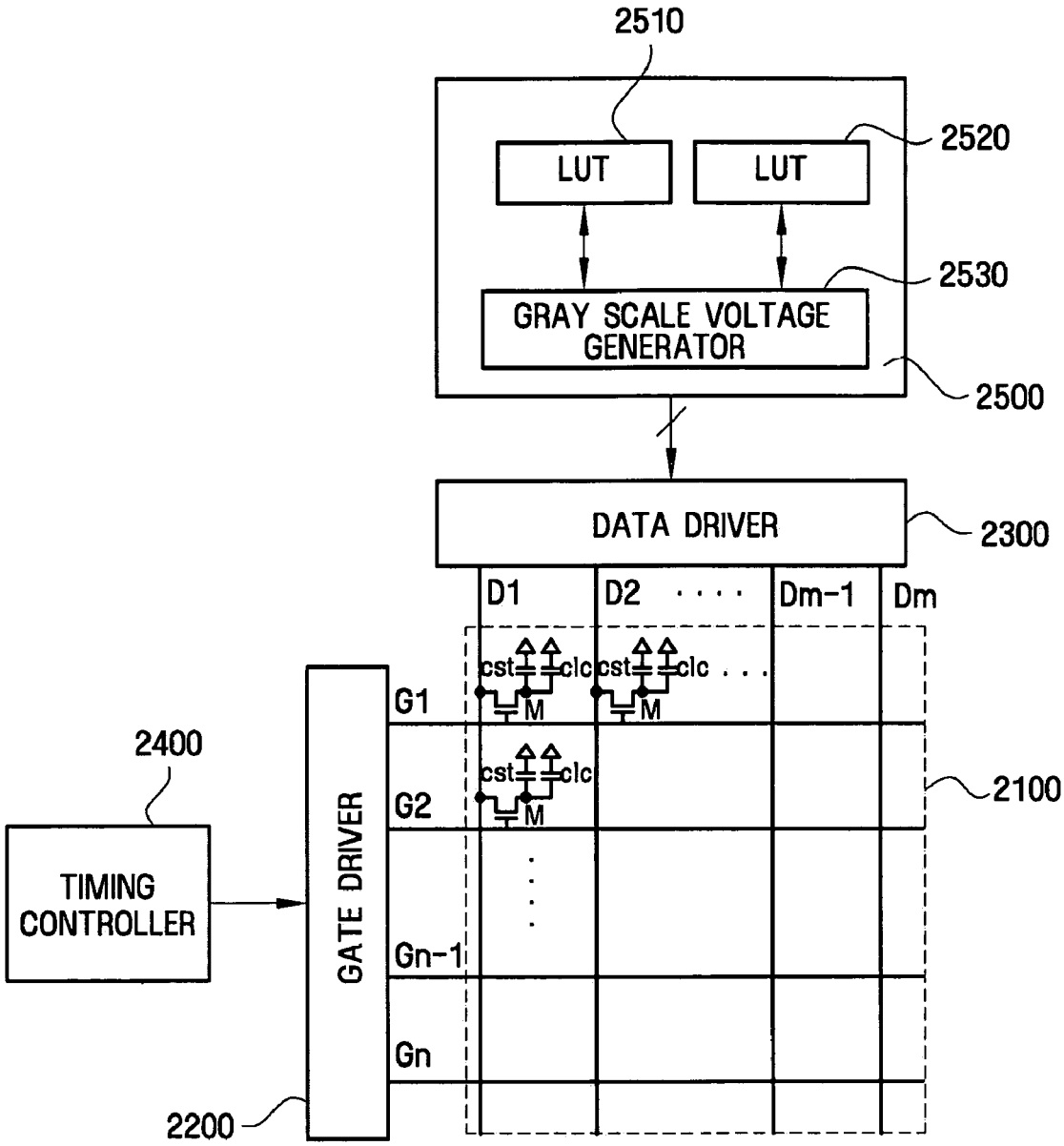
FIG. 7 shows the structure of an LCD according to another embodiment of the invention.
Figure 8:
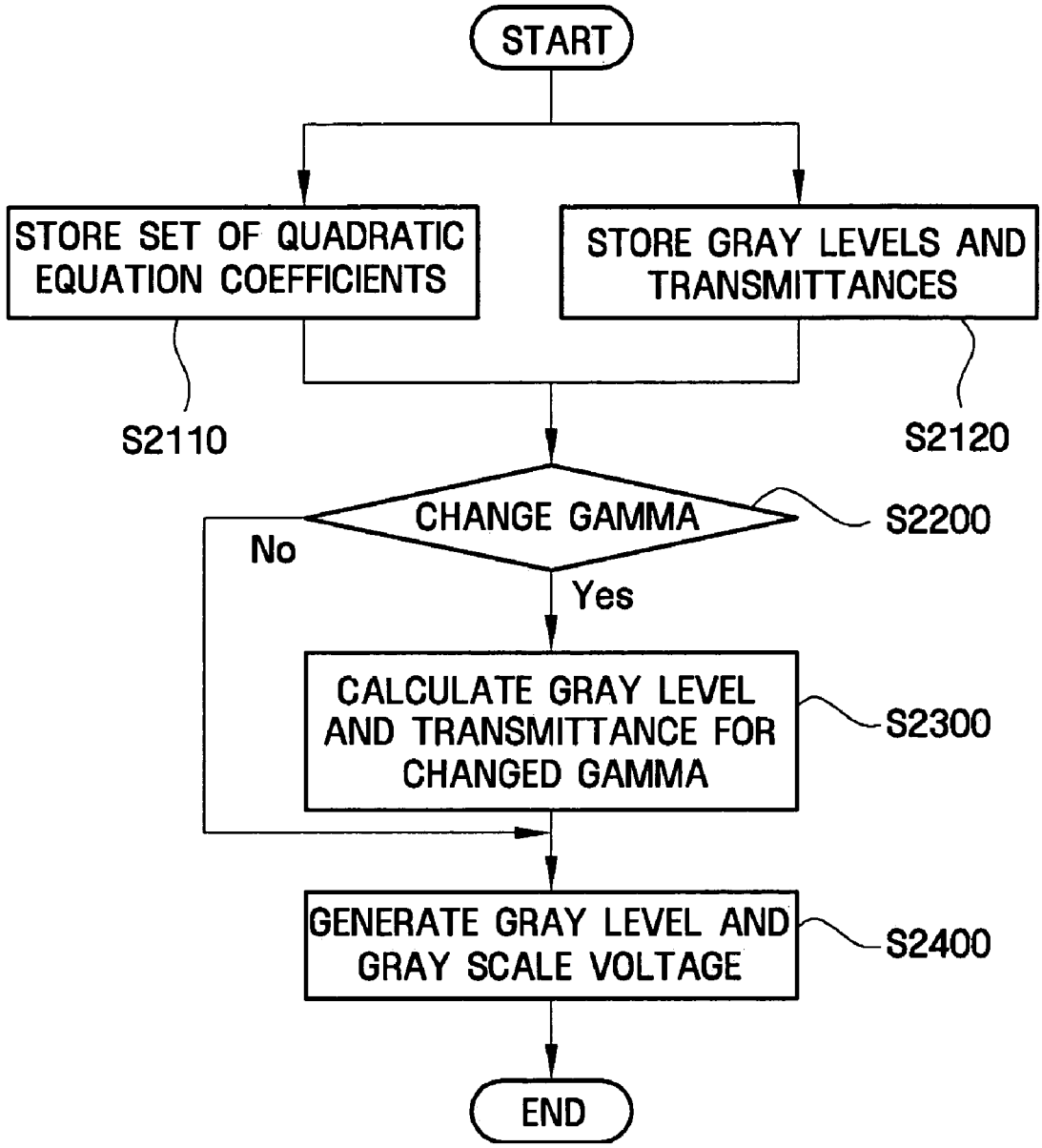
FIG. 8 is a flowchart showing a method of correcting a gamma value of the LCD shown in FIG. 7 according to an embodiment of the invention.
Figure 9A:
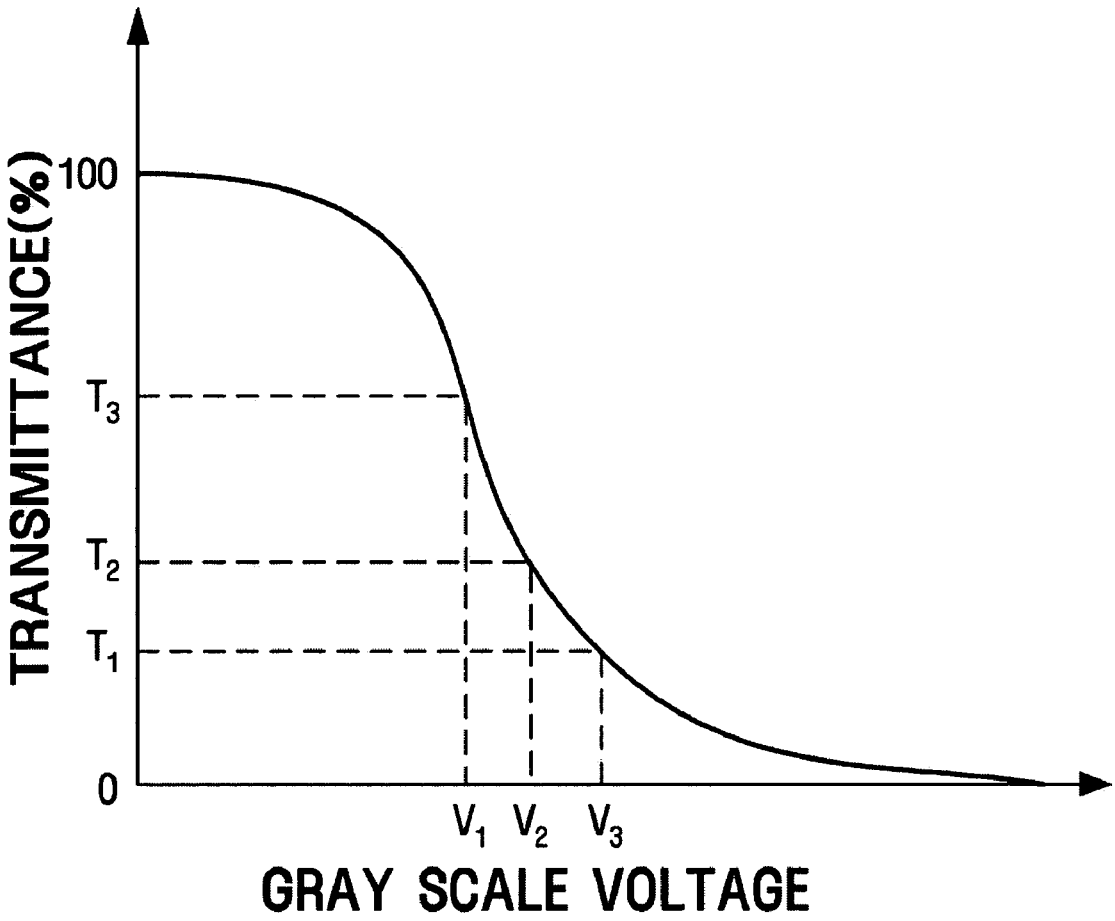
FIG. 9A is a graph showing transmittance vs. gray scale voltage for the LCD shown in FIG. 7.
Figure 9B:
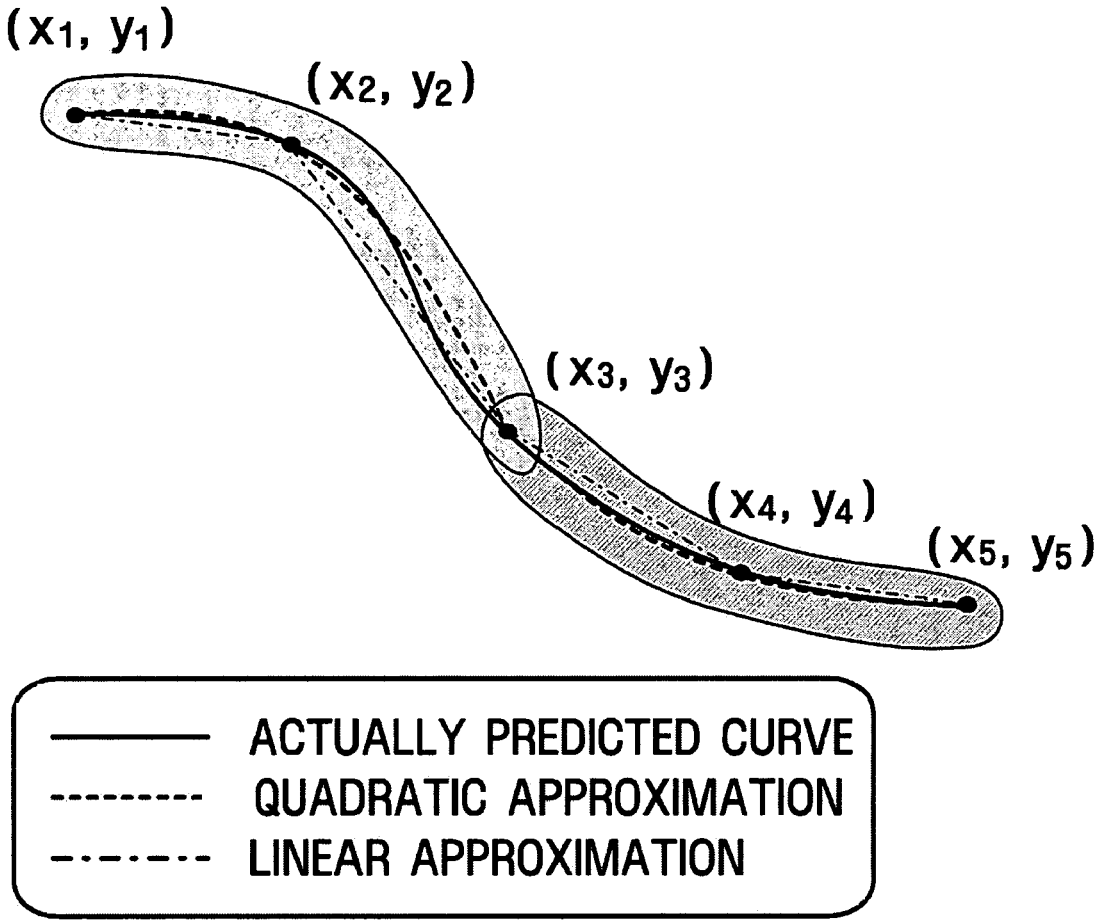
FIG. 9B is a graph obtained by approximating a curve of transmittance vs. gray scale voltage for the LCD shown in FIG. 7 using a piecewise quadratic interpolation technique.
Figure 10:
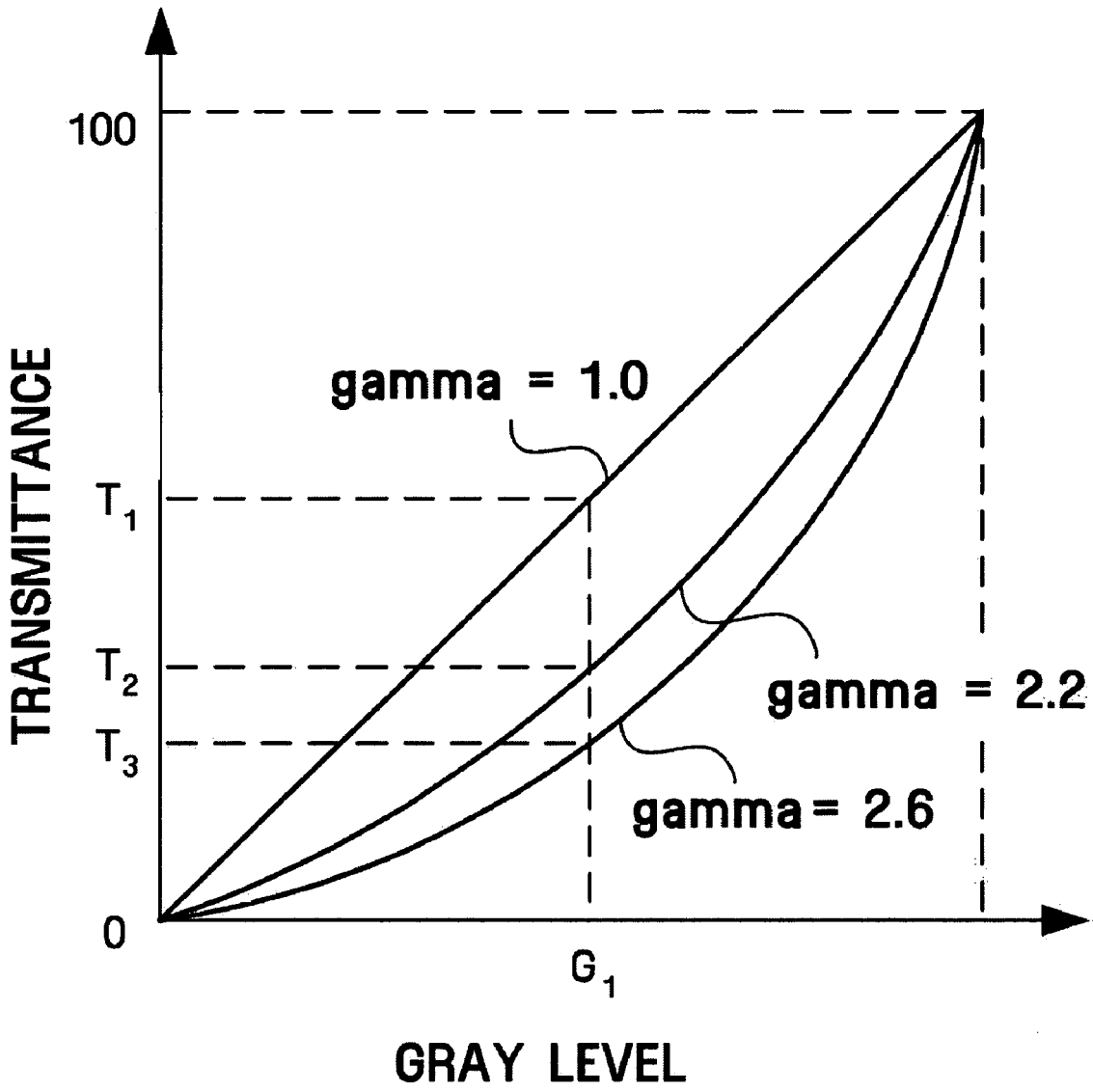
FIG. 10 is a graph showing transmittance vs. gray level curves when gamma values are 1.0, 2.2, and 2.6, respectively.

FIG. 7 shows the structure of the LCD according to another embodiment of the invention and FIG. 8 is a flowchart illustrating a method of correcting a gamma value of the LCD according to an embodiment of the invention. FIG. 9A is a graph showing transmittance vs. gray scale voltage for the LCD shown in FIG. 7, and FIG. 9B shows a graph obtained by approximating a curve of transmittance vs. gray scale voltage for the LCD using a piecewise quadratic interpolation technique. FIG. 10 is a graph showing transmittance vs. gray level curves when gamma values are 1.0, 2.2, and 2.6, respectively.

Referring to FIG. 7, the LCD includes a liquid crystal panel 2100, a gate driver 2200, a data driver 2300, a timing controller 2400, and a gray scale voltage provider 2500.

The timing controller 2400 produces a horizontal synchronization start signal to be transmitted to the data driver 2300 or a gate clock signal to be transmitted to the gate driver 2200. The gray scale voltage provider 2500 includes a LUT 2510 to store a set of quadratic equation coefficients, a LUT 2520 to store gray levels and transmittance, and a gray scale voltage generator 2530. The operation of the gray scale voltage provider 2500 is described below with reference to FIGS. 8, 9, and 10.

Referring to FIG. 8, in operation S2110 includes storing a set of quadratic equation coefficients. For example, the set of quadratic equation coefficients may be calculated for every three measured data from among a plurality of data representing transmittance of the LCD that are a function of gray scale voltages and stored in the LUT 2510 to satisfy the three adjacent measured data. Specifically, referring to FIG. 9B, when transmittance are measured at five points, a quadratic equation that satisfies adjacent three data (x1, y1), (x2, y2), and (x3, y3) out of five measured data (x1, y1), (x2, y2), (x3, y3), (x4, y4), and (x5, y5) is defined in Equation (1):

$$y=p1*x^2+p2*x+p3 \tag{1}$$

where x and y respectively denote gray scale voltage and transmittance.

The quadratic equation is represented as a vector as shown in Equations 2 through 5. Coefficients of the quadratic equation satisfying the three measured data may be calculated using Equation (6):

$$AX=B \tag{2}$$

$$A=\begin{bmatrix} x1^2 & x1 & 1 \\ x2^2 & x2 & 1 \\ x3^2 & x3 & 1 \end{bmatrix} \tag{3}$$

$$B=\begin{bmatrix} y1 \\ y2 \\ y3 \end{bmatrix} \tag{4}$$

$$X=[p1,p2,p3] \tag{5}$$

$$X=A^{-1}B \tag{6}$$

To generate a continuous quadratic curve, a set of quadratic equation coefficients that satisfy successively adjacent three measured data, in which the last two_data (x3, y3) and (x4, y4) or one data (x3, y3) are interpolated from among three adjacent measured data (x2, y2), (x3, y3) and (x4, y4) or (x3, y3), (x4, y4), and (x5, y5), are calculated and stored in the LUT 2510 for a set of quadratic equation coefficients. Quasi-continuous data for transmittance that is a function of a gray scale voltage shown in FIG. 9A may be generated by repeating the operation of obtaining the quadratic curve.

Referring to FIG. 9B, quadratic curve approximation reduces an error between the actual and approximated curves as compared to linear approximation. Further despite there being a trade-off between the number of measured data and accuracy of transmittance as a function of gray scale voltage, data is measured at denser (equal) intervals on high and low transmittance regions and at sparser (unequal) intervals on an intermediate transmittance region considering memory constraints, thereby reducing an error between the actual and approximated curves.

In operation S2120 of storing gray levels and transmittance, the gray scale voltage generator 2530 calculates a gray level and a transmittance so that the relationship between the gray level (GrayLevel) and the transmittance (T) for a specified gamma value y, as shown in FIG. 10, satisfies Equation (7) and stores the same in the LUT 2520 for gray levels and transmittance.

$$T=T_{max}*(\text{GrayLevel}/\text{Maximum GrayLevel})^{\gamma} \tag{7}$$

When the specified gamma value in a predetermined gray level range (e.g., between 0 and 200) is different than a gamma value outside the predetermined gray level range, the gray scale voltage generator 2530 calculates gray level and transmittance for each gamma value and stores the same in the LUT 2520 for gray levels and transmittance. When screen brightness information is analyzed to extract a brightness histogram and adjust a gamma value based on the histogram, e.g., during dynamic gamma capture/compensation (DGC) when at least three gamma values exist, the gray scale voltage generator 2530 calculates gray level and transmittance corresponding to each gamma value and stores the same in the LUT 2520 for gray levels and transmittance. The above described operations effectively improve still picture quality. Further, it is understood that the operations S2110 and S2120 may be reversed.

The gray scale voltage generator 2530 determines whether a gamma value is changed in operation S2200. In operation S2300 of updating a gray level and a transmittance, when the gamma value is changed, the gray scale voltage generator 2530 calculates a new transmittance that satisfies the following Equation (8) using the changed gamma value γ1 and stores the transmittance in the LUT 2520 for gray levels and transmittance.

$$T=T_{max}*(\text{GrayLevel}/\text{Maximum GrayLevel})^{\gamma 1} \quad (8)$$

In operation S2400 of determining a gray level and a gray scale voltage, the gray scale voltage generator 2530 generates a gray scale voltage for a gray level corresponding to the changed gamma value γ1 according to a piecewise quadratic interpolation technique using a set of quadratic equation coefficients stored in the LUT 2510 and gray levels and transmittance corresponding to the changed gamma value γ1 stored in the LUT 2520. In Equation (9), the value of x, i.e., a gray scale voltage corresponding with a gray level, may be obtained by substituting a transmittance for a gray level into y:

$$y=p1*(x1^2+\Delta x)+p2*(x1+\Delta x)+p3 \quad (9)$$

As a result, a new relationship between a gray level and a gray scale voltage may be obtained for the changed gamma value γ1. In this way, a gamma value may be corrected according to the type of liquid crystal in an LCD or marginal illumination, which may adjust brightness across the entire screen of the and effectively improve the quality of a still image.

Conversely, when the gamma value is not changed, the existing gray level and gray scale voltage are maintained.

An LCD according to yet another embodiment of the invention and a method for determining a gray scale voltage in DCC and correcting a gamma value of the LCD according to an embodiment of the invention are described below with reference to FIGS. 11, 12, and 13.

Figure 11:
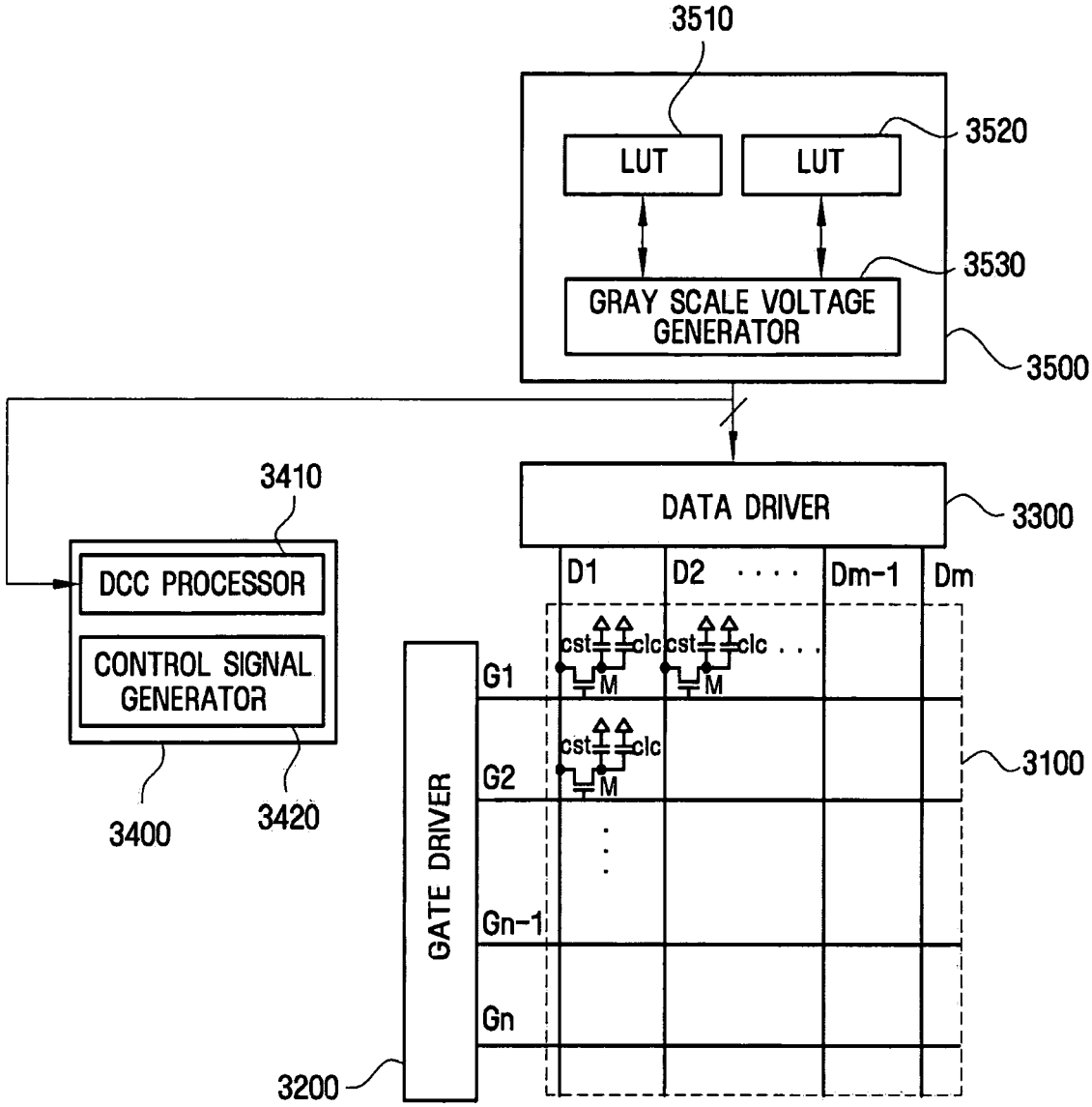
FIG. 11 shows the structure of an LCD according to yet another embodiment of the invention.
Figure 12:
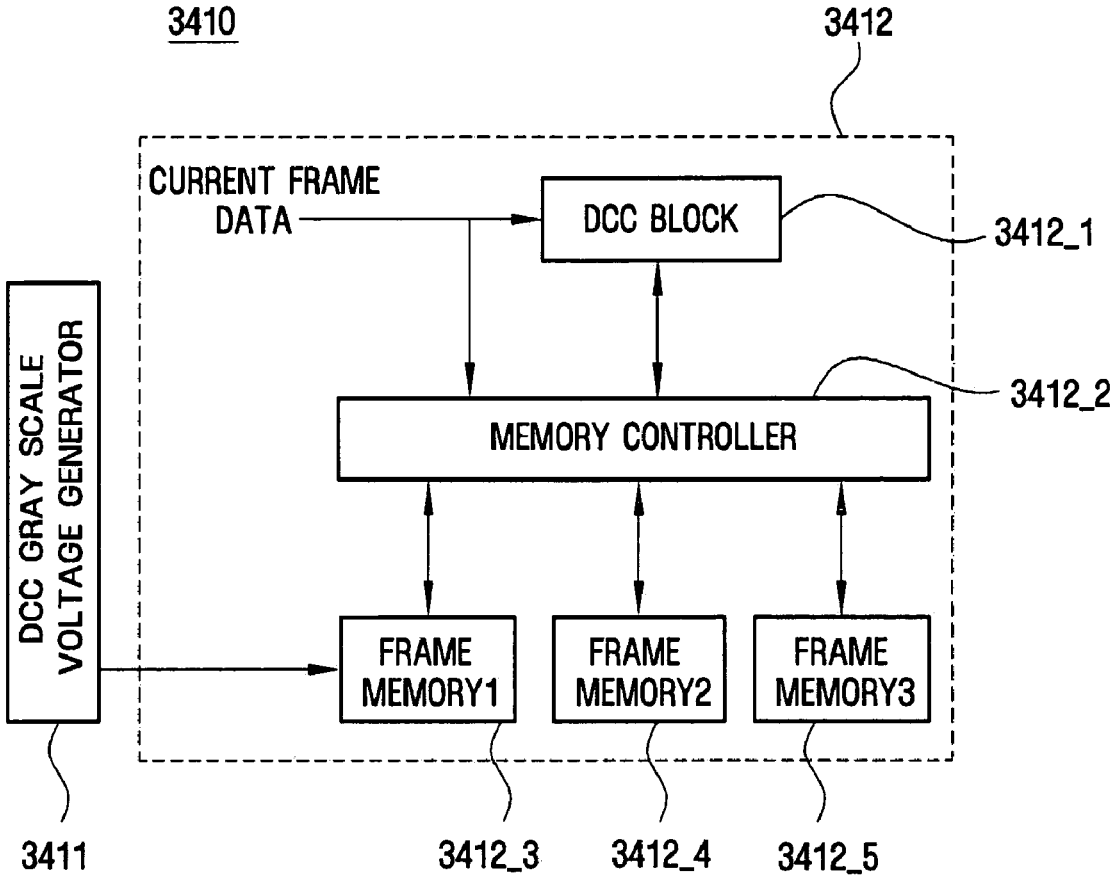
FIG. 12 shows the configuration of the DCC processor in the LCD shown in FIG. 11.

FIG. 11 shows the structure of an LCD according to an embodiment of the invention. FIG. 12 shows the configuration of a DCC processor 3410 in the LCD shown in FIG. 11. FIG. 13 is a flowchart illustrating a method of determining a gray level in DCC and correcting a gamma value on the LCD shown in FIG. 11 according to an embodiment of the invention. Differences from the LCDs according to the embodiments of the invention discussed above and shown in FIGS. 1-10 are described below.

Referring to FIG. 11, the LCD includes a liquid crystal panel 3100, a gate driver 3200, a data driver 3300, a DCC processor 3410, and a gray scale voltage provider 3500. The detailed operation of the DCC processor 3410 and the gray scale voltage provider 3500 are described below with reference to FIGS. 12 and 13.

Figure 13:
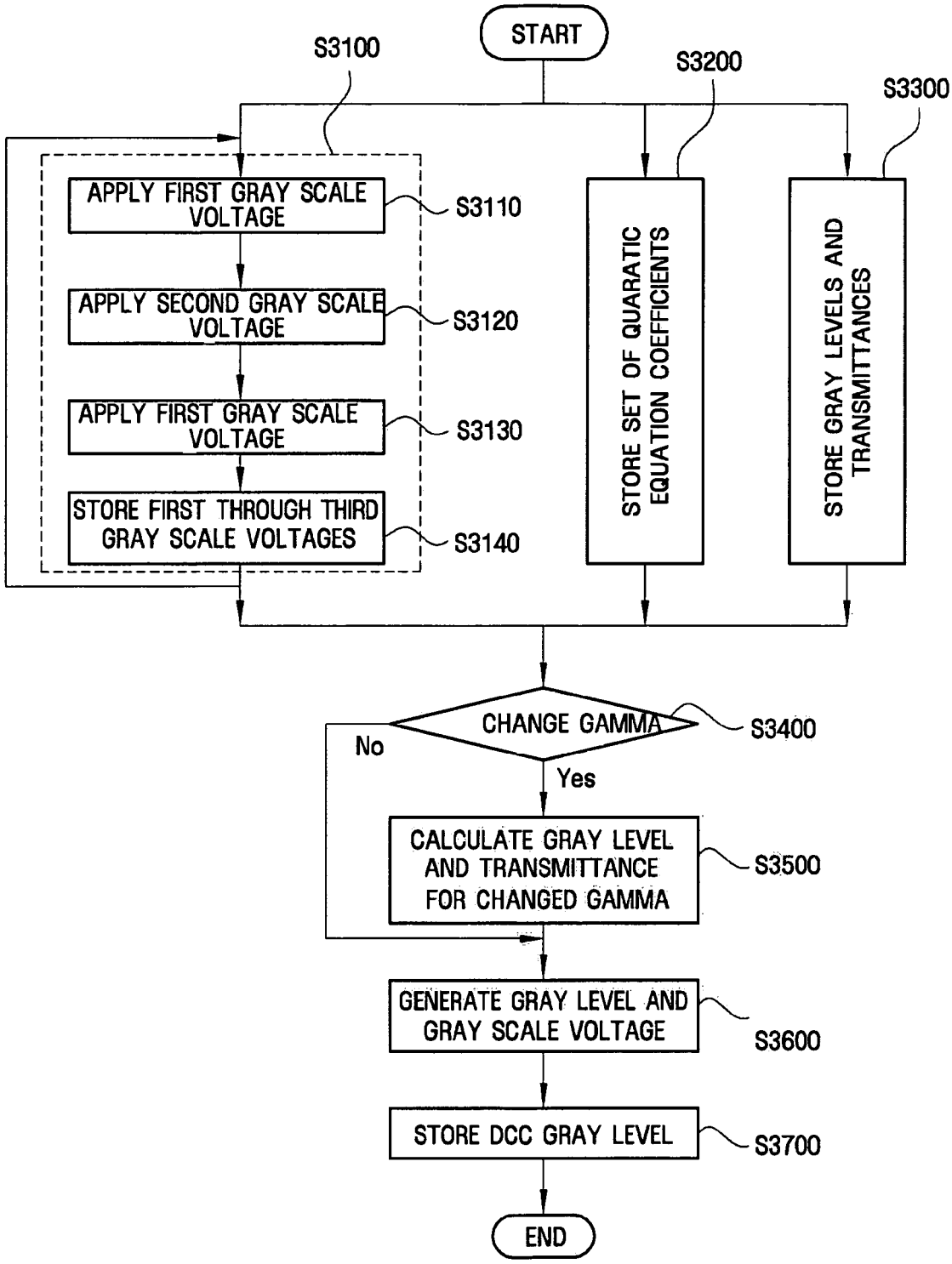
FIG. 13 is a flowchart showing a method of determining a gray level in DCC and correcting a gamma value on the LCD shown in FIG. 11 according to an embodiment of the invention.

Referring to FIG. 13, in operation S3100 of storing DCC gray scale voltages, a DCC gray scale voltage generator 3411 stores first, second, and third gray scale voltages Gk−1, Gk, and Res1 in a DCC gray scale voltage LUT that may be located within the DCC gray scale voltage generator 3411.

In operation S3200 of storing a set of quadratic equation coefficients, the set of quadratic equation coefficients are calculated for every three measured data, among a plurality of data representing transmittance of the LCD that are a function of gray scale voltages, to satisfy the three adjacent measured data, and are stored in a LUT 3510 that stores a set of quadratic equation coefficients.

In operation S3300 of storing gray levels and transmittance, a gray scale voltage generator 3530 calculate a gray level and a transmittance so that the relationship between the gray level GrayLevel and the transmittance T for a predetermined gamma value y satisfies the Equation (7) and stores the same in a LUT 3520 that stores gray levels and transmittance. It is understood that the operations S3100, S3200, and S3300 may be performed in random order.

In operation S3400, the gray scale voltage generator 3530 determines whether a gamma value is changed. When the gamma value is changed, in operation S3500 of updating a gray level and a transmittance the gray scale voltage generator 3530 calculates a new transmittance that satisfies the Equation (8) using a changed gamma value γ1 after storing the gray levels and the transmittance in operation S3300, and stores the transmittance in the LUT 3520 that stores gray levels and transmittance.

In operation S3600 of determining a gray level and a gray scale voltage, the gray scale voltage generator 3530 generates a gray scale voltage for a gray level corresponding to the changed gamma value γ1 by a piecewise quadratic interpolation technique using a set of quadratic equation coefficients stored in the LUT 3510 that stores a set of quadratic equation coefficients and gray levels and transmittance corresponding to the changed gamma value γ1stored in the LUT 3520 for gray levels and transmittance. As a result, a new relationship between a gray level and a gray scale voltage may be obtained for the changed gamma value γ1.

However, when the gamma value is not changed, the existing gray level and gray scale voltage are maintained.

In operation S3700 of converting a gray scale voltage into a DCC gray level, a memory controller 3412_2 of a DCC gray level generator 3412 receives a gray level and a gray scale voltage corresponding to the original gamma value or corrected gamma value from the gray scale voltage provider 3500 and respectively converts the first, second, and third gray scale voltages Gk- 1, Gk, and Res1 stored in the DCC gray scale voltage LUT into first, second, and third gray levels using a selected gamma value. The first, second, and third gray levels are stored in a frame memory 1 3412_3 as a gray level for the previous frame period, a DCC gray level, and a gray level for the current frame period, respectively.

Since DCC gray scale voltages are stored in the DCC gray scale voltage LUT, when a gamma value is corrected, the DCC gray level generator 3412 may provide DCC gray levels using gray levels and gray scale voltages corresponding to the corrected gamma value, which are received from the gray scale voltage provider 3500. The gray scale voltage provider 3500 may also correct a gamma value according to the type of liquid crystal in an LCD or marginal illumination using the LUT 3510 that stores a set of quadratic equation coefficients and the LUT 3520 that stores gray levels and transmittance, thus adjusting brightness across the entire screen of the LCD and improving the quality of a still image. Thus, the LCD according to the embodiment of the invention discussed above and shown in FIG. 7 may improve the quality of both moving and still images.

It is understood that those skilled in the art will appreciate that many variations and modifications can be made to the embodiments discussed above without substantially departing from the principles of the present invention. Therefore, the disclosed embodiments of the invention are used in a generic and descriptive sense only and not for purposes of limitation.

As discussed above, LCDs of the present invention may effectively improve the quality of still and/or moving images.

As discussed above, the LCDs of the present invention use gray levels and gray scale voltages corresponding to a single gamma may provide gray levels and gray scale voltages for each corrected gamma value, thereby realizing their full potential within limited capacity of memory.

A DCC technique implemented in the LCDs of the invention enables DCC gray scale voltages to be more accurately and quickly calculated without inter-observer error.

A method for correcting a gamma value of an LCD according to an embodiment of the invention makes it possible to quickly and accurately provide gray scale voltages and gray levels for any corrected gamma value, thereby allowing for an easier gamma correction.

A method for determining a gray level in DCC on the LCD according to an embodiment of the invention may be used to perform both DCC and gamma correction, thereby effectively improving the quality of still and moving images on the LCD.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal panel comprising:

a plurality of gate lines, a plurality of data lines, and a plurality of pixels, each pixel comprising a switching element connected with a corresponding gate line and a corresponding data line;

a gate driver applying gate signals to the gate lines;

a data driver providing gray scale voltages corresponding to data signals for gray levels having a predetermined gamma value to the data lines;

a gray scale voltage generator generating gray scale voltages for gray levels having the predetermined gamma value and transmitting the generated gray scale voltages to the data driver; and a dynamic capacitance compensation processor, comprising:

a dynamic capacitance compensation gray scale voltage generator, and a dynamic capacitance compensation gray level generator, wherein the dynamic capacitance compensation gray scale voltage generator applies a first gray scale voltage having the predetermined gamma value to a pixel electrode during a plurality of frame periods, a second gray scale voltage having a predetermined difference from the first gray scale voltage to the pixel electrode during a single frame period, and a third gray scale voltage relating to a peak gray scale voltage in the pixel electrode during the single frame when the second gray scale voltage is applied, stores the first gray scale voltage, the second gray scale voltage, and the third gray scale voltage in a look-up table, and wherein the dynamic capacitance compensation gray level generator receives the first gray scale voltage, the second gray scale voltage, and the third gray scale voltage stored in the look-up table from the dynamic capacitance compensation gray scale voltage generator, converts the first gray scale voltage, the second gray scale voltage, and the third gray scale voltage into a first gray level, a second gray level, and a third gray level, respectively, using the predetermined gamma value, stores the first gray level, the second gray level, and the third gray levels as a gray level for a previous frame period, a dynamic capacitance compensation gray level, and a gray level for a current frame period, respectively.

2. The liquid crystal display of claim 1, wherein the first gray scale voltage is applied for more than three time periods before the second gray scale voltage is applied.

3. The liquid crystal display of claim 1, wherein the first gray scale voltage is applied for more than three time periods after the second gray scale voltage is applied.

4. The liquid crystal display of claim 1, wherein the first gray scale voltage is applied to the pixel electrode for the same number of time periods before and after the second gray scale voltage is applied.

5. A method of determining a dynamic capacitance compensation gray level on a liquid crystal display, the method comprising:

storing a dynamic capacitance compensation gray level by applying a first gray scale voltage corresponding to a first gray level having a predetermined gamma value to a pixel electrode during a plurality of frame periods, applying a second gray scale voltage corresponding to a second gray level having a predetermined difference from the first gray level to the pixel electrode during a one frame period, applying the first gray scale voltage to the pixel electrode during a plurality of frame periods, and storing the first gray scale voltage, the second gray scale voltage, and a third gray scale voltage in a dynamic capacitance compensation gray scale voltage look-up table, the third gray scale voltage is a peak gray scale voltage measured in the pixel electrode during the one frame period when the second gray scale voltage is applied and corresponds to a third gray level; and converting a gray scale voltage into a dynamic capacitance compensation gray scale level by converting the first gray scale voltage, the second gray scale voltage, and the third gray scale voltage into the first gray level, the second gray level, and the third gray level using the predetermined gamma value, and storing the first gray level, the second gray level, and the third gray level as a gray level for a previous frame period, a dynamic capacitance compensation gray level, and a gray level for a current frame period, respectively.

6. The method of claim 5, further comprising:

repeating the applying of the first gray scale voltage, the second gray scale voltage, and the first gray scale voltage, and the storing of the first gray scale voltage, the second gray scale voltage, and the third gray scale voltages for each of a plurality of first gray scale voltages.

7. The method of claim 5, wherein when applying the first gray scale voltage before applying the second gray scale voltage, the first gray scale voltage is applied to the pixel electrode for more than three frame periods.

8. The method of claim 5, wherein when applying the first gray scale voltage after applying the second gray scale voltage, the first gray scale voltage is applied to the pixel electrode for more than three frame periods.

9. The method of claim 5, wherein the first gray scale voltage is applied to the pixel electrode for the same number of frame periods before and after the second gray scale voltage is applied thereto.

* * * * *